US005184384A

United States Patent [19]

Lipp

[11] Patent Number: 5,184,384

[45] Date of Patent: Feb. 9, 1993

[54] FOLDING MACHINE

[75] Inventor: Xaver Lipp, Ellwangen, Fed. Rep. of Germany

[73] Assignee: Reinhardt Maschinenbau GmbH, Sindelfingen, Fed. Rep. of Germany

[21] Appl. No.: 776,359

[22] PCT Filed: Apr. 3, 1990

[86] PCT No.: PCT/EP90/00522

§ 371 Date: Jan. 8, 1992

§ 102(e) Date: Jan. 8, 1992

[87] PCT Pub. No.: WO90/14180

PCT Pub. Date: Nov. 29, 1990

[30] Foreign Application Priority Data

May 20, 1989 [DE] Fed. Rep. of Germany ..... 3916445

[51] Int. Cl.[5] ..... B23P 11/00

[52] U.S. Cl. ..... 29/243.5

[58] Field of Search ..... 29/243.5, 243.58; 72/181, 210

[56] References Cited

U.S. PATENT DOCUMENTS 3,609,845 10/1971 Taylor .
3,662,699 5/1972 Harn et al. ..... 29/243.5
4,027,611 6/1977 Ward et al. ..... 29/243.5
4,726,107 2/1988 Knudson ..... 29/243.5
4,872,331 10/1989 Skelton ..... 29/243.5
4,989,308 2/1991 Sanders ..... 29/243.5

FOREIGN PATENT DOCUMENTS 1907414 12/1964 Fed. Rep. of Germany .
1602453 8/1970 Fed. Rep. of Germany .

*Primary Examiner*—Robert C. Watson
*Attorney, Agent, or Firm*—Shenier & O'Connor

[57] ABSTRACT

In a bending machine especially for joining the edges of metal sheets by folding, the machine having a frame which provides supporting surfaces for the components to be folded and carrying a folding device consisting of several pairs of folding rollers (32) on a carriage (25) which can be moved along a guide (24) in the machine frame (1) by means of a drive device, the frame (1) being U-shaped with the supporting surfaces at the upper ends of the arms of the U forming an angle of 90° therebetween and with one of the surfaces extending generally in the vertical direction and the carriage arranged on the yoke (2) of the U with a pivot arm (22) mounted on the machine frame for movement around an axis parallel to the direction of carriage movement to a lockable operative position at whcih a strip rail (21) on the arm extending parallel to said axis is spaced below the lower end of the one supporting surface extending generally in the vertical direction.

15 Claims, 6 Drawing Sheets

Fig.5
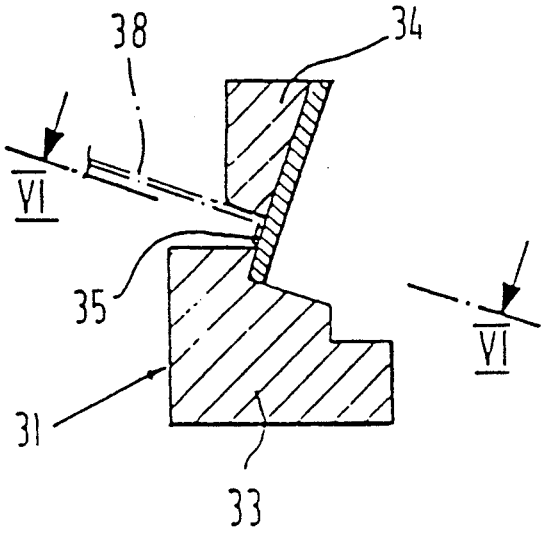
Fig.6
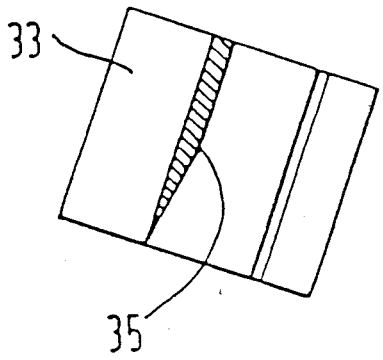
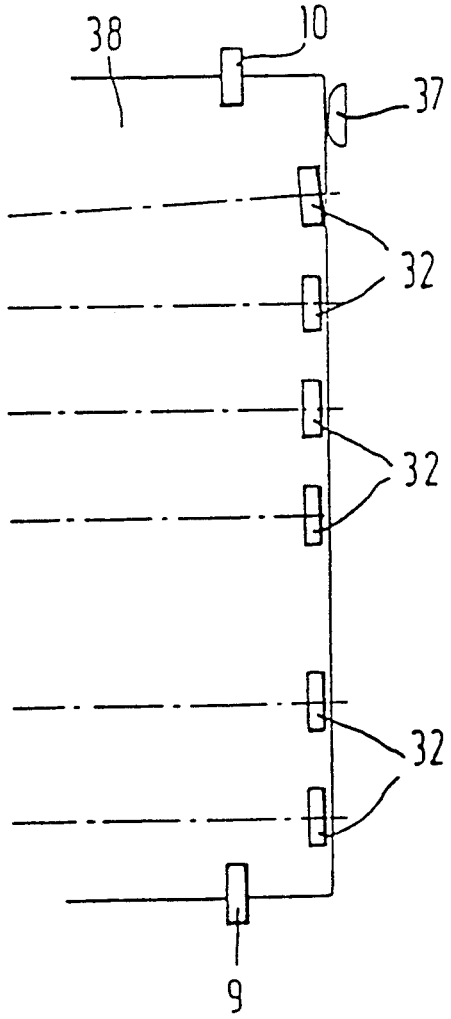
Fig.7

FOLDING MACHINE

The invention relates to a folding machine, in particular for joining the edges of metal sheets by folding, comprising a machine frame which has supporting surfaces for the parts to be folded and a folding device consisting of a plurality of pairs of folding rollers.

In the known folding machines, four people are required when large sheets of metal are intended to be joined by folding because the two sheet metal panels have to be held by two people each at the front and back. This is due to the fact that the sheet metal edges must pass through the folding device which is rigidly connected to the frame and one metal sheet must hereby be held in engagement on the associated supporting surface. If, for example, ducts are formed from the metal sheets, the operators must bring the workpiece back into its original position following a bending or folding process, ready for the next bending or folding process.

The object underlying the invention is to provide a folding machine which enables two metal sheets, from which a duct having a rectangular cross section can subsequently be manufactured, to be joined together at right angles in a simple manner and dispensing with operating personnel. This object is accomplished by a folding machine having the features of claim 1.

Due to the fact that the pairs of folding rollers are provided on a carriage which is displaceable along a guide means of the machine frame, the workpieces, i.e., for example, two sheet metal panels which are to be joined to one another, can be secured in position on the machine since they need not be moved relative to the machine frame during the folding process. Therefore, no operator is required during the folding process to hold the workpiece or workpieces.

The carriage can be pulled or drawn, for example by means of a chain, or also pushed, for example by means of a cylinder/piston unit. In a preferred embodiment, however, a gear rack is provided and a gear wheel meshing therewith, in accordance with claims 3 and 4.

In order to keep both workpieces, sheet metal panels or the like in engagement on the supporting surfaces without auxiliary means, the first of the two supporting surfaces is preferably inclined relative to the vertical, in accordance with claim 5.

Handling of the workpieces is also made easier by a stop rail according to claim 6.

The generally panel-shaped workpieces are secured in position, in a preferred embodiment, by means of holding devices, which are preferably clamping devices and can overlap the forward and rear edges of a metal sheet. These holding devices are expediently provided so as to be adjustable on rails in their longitudinal direction in order to be able to adapt their position to the requirements of the workpieces which are of differing lengths. Since, however, the beginning of the workpiece can always be provided at the same location, it is sufficient for the holding device grasping the beginning of the workpiece to be displaceable in accordance with the width of the edge to be grasped and then released again. This displacement is brought about in a preferred embodiment by means of a pivotable actuating lever.

The machine frame, which is preferably U-shaped in cross section, advantageously has a guide rail for the carriage between the two arms. The supporting surface can then be provided in the region of the free ends of the two arms. The carriage is preferably guided on this guide rail in accordance with claim 11. The forces occurring can then be passed without problem into the guide rail. This also applies for the force brought about by the drive when a pinion driven by an electromotor is provided on the carriage and this pinion engages in a gear rack provided on the rail.

In a preferred embodiment, the carriage has a design according to claims 12 and 13. The cross section of the connecting member can then be selected to be relatively small.

So that the workpieces have and retain the correct position during the folding process, at least the first pair of folding rollers is designed according to claim 14. In addition, it is expedient for adaptation to different workpieces for at least one folding roller of each pair of folding rollers to be arranged on the holding device so as to be vertically adjustable.

In the following, the invention is explained in greater detail on the basis of an embodiment illustrated in the drawings. In the drawings, FIG. 1 shows a front view of the embodiment without folding rollers and their carrier device;

FIG. 5 is a section of the carrier device along line V—V in FIG. 4;

FIG. 6 is a section of the web of the carrier device along line VI—VI of FIG. 5;

FIG. 7 is a plan view onto the upper folding rollers of the pairs of folding rollers, a stop for the sheet metal panels engaged by the folding rollers and the clamping devices holding the sheet metal panels;

Figure 1:
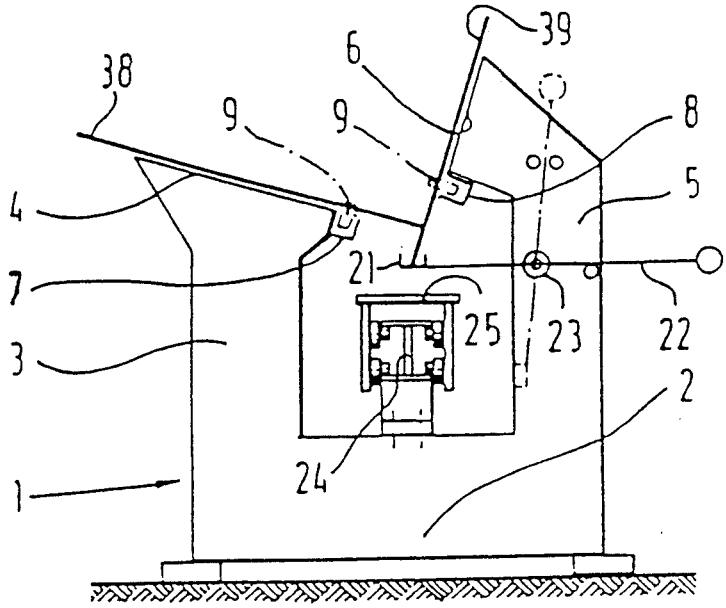

A folding machine has, as shown in FIG. 1, a machine frame 1 which is similar to a U in cross section and the yoke portion 2 of which forms the foot of the machine frame. One arm 3 of the machine frame 1, which is somewhat shorter, extends vertically upwards and is broadened in the region of its upper end to form a supporting surface 4. The supporting surface 4 is inclined toward the other arm 5, which is somewhat longer, at an angle of approximately 20° in relation to the horizontal. The arm 5 is bent at an angle towards the other arm 3 at its upper end and is also broadened to form a supporting surface 6. This supporting surface 6, which is plane in design like the supporting surface 4, extends perpendicularly to the plane defined by the supporting surface 4. It therefore forms an angle of approximately 20° with the vertical.

Figure 2:
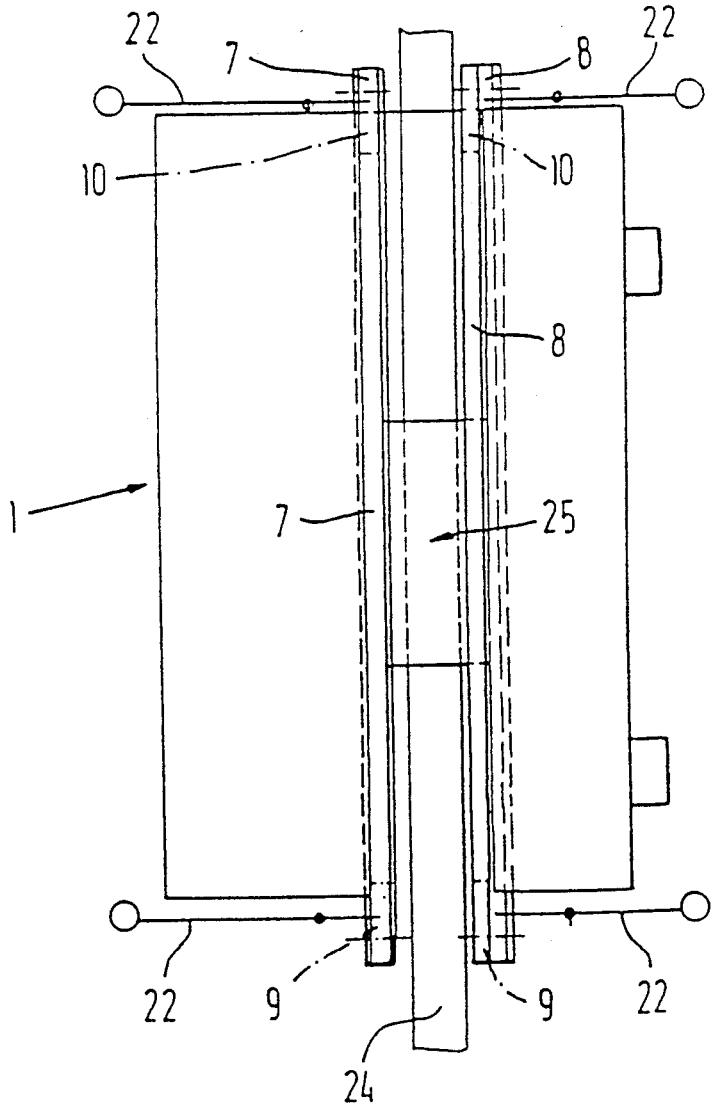
FIG. 2 shows a plan view onto the embodiment.
Figure 8:
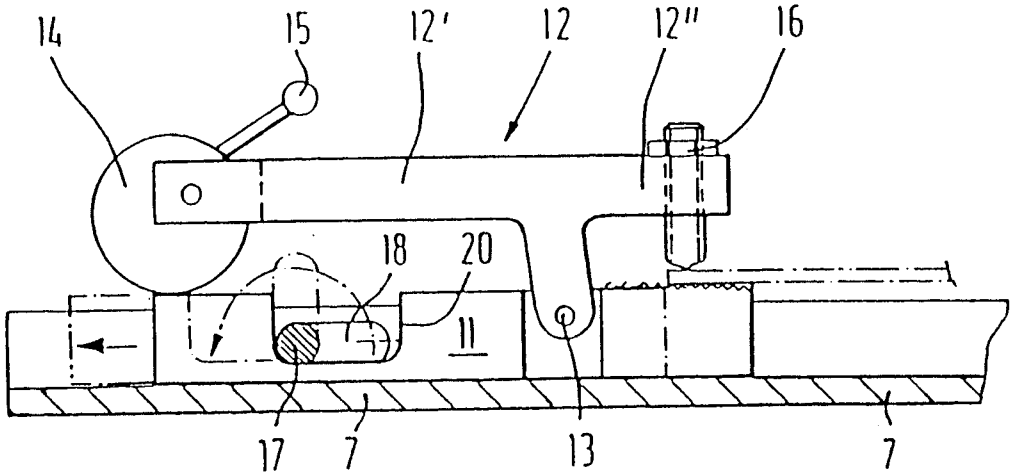
FIG. 8 is a plan view onto a clamping device in the installed state.
Figure 9:
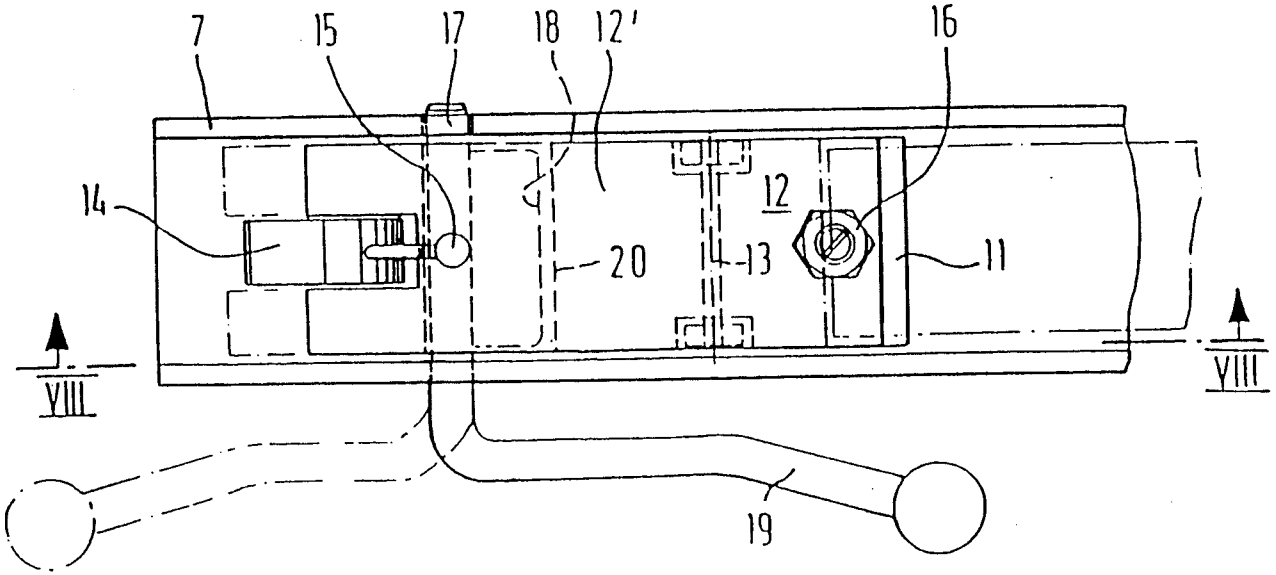
FIG. 9 is a section along line IX—IX in FIG. 8.

An upwardly open U-shaped rail 7 is rigidly attached to the arm 3 at the side thereof facing inwards and slightly beneath the supporting surface 4. As shown in FIG. 2, this rail protrudes beyond the two end faces of the arm 3. A corresponding U-shaped rail 8 is secured to the underside of the angled end section of the arm 5 such that it also does not protrude into the plane defined by the supporting surface 6. The U-shaped rail 8 also protrudes beyond the two end faces of the arm 5. The two U-shaped rails 7 and 8 each serve to accommodate, in a longitudinally adjustable manner, two clamping devices 9 and 10, by means of which the forward and rearward ends, respectively, of the sheet metal panels can be overlapped and securely clamped. The clamping devices 9 gripping the forward edge, i.e. the edge at which the folding process begins, have, as shown in FIGS. 8 and 9, a block-shaped base member 11 located in the U-shaped rail 7 or 8, respectively. The upper side of this base member protrudes slightly beyond the open side of the U-shaped rail. A double-armed pivot lever 12 is mounted in this base member 11 for pivoting movement about an axis 13 extending transversely to the longitudinal direction of the U-shaped rail and parallel to its yoke portion. For this purpose, two legs of the pivot lever 12 each extend into a lateral recess of the base member 11, as shown in FIGS. 8 and 9. The pivot lever 12 has a long arm 12' which bears at its free end, in a slit, an eccentric 14 rotatable about an axis parallel to the axis 13. This eccentric abuts on the upper side of the base member 11 and can be turned by means of a hand lever 15. The short arm 12" of the pivot lever 12 points towards the center of the machine and bears a setscrew 16 in a thread. A sheet metal panel can be clamped between this screw and the upper side of the base member 11 which is roughened at this point. Thanks to the setscrew 16, the clamping device 9 can be adapted to various panel thicknesses.

As shown in FIGS. 8 and 9, the base member 11 is provided with an upwardly open transverse groove 20 penetrated by a shaft 17 which is rotatably mounted in the U-shaped rail and from which a shift element 18 projects in radial direction like the bit of a key. The shaft 17 and the shift element 18 can be pivoted by means of a lever 19. In the pivot position illustrated in FIG. 8 the shift element 18 abuts on one flank of the transverse groove 20 and thereby firmly holds the clamping device 9 at one end of its path of movement in the U-shaped rail. If the lever 19 is pivoted through 180°, the shift element 18 then comes into engagement on the other flank of the transverse groove 20 and displaces the clamping device into its other end position. The entire path of displacement is selected to be somewhat longer than the depth of the clamping jaw, which is formed by the short arm 12" and the section of the base member 11 opposite thereto, so that the clamping device 9 can be withdrawn due to a pivoting movement of the lever 19 through 180° and when viewed in the direction according to FIG. 8 in the anticlockwise direction to such an extent that the edge of a sheet metal panel which is first overlapped is released.

The two clamping devices 10 which grasp the rearward end of the sheet metal panels must be displaceable over a greater distance in the U-shaped rail due to the differing lengths of the sheet metal panels. They are, therefore, not provided with the shifting device formed by the shaft 17 and the shift element 18 but with a gripping device which firmly grasps the base member in the U-shaped rail between its two parallel arms. Otherwise, they are designed like the clamping devices 9.

In order to be able to bring the workpieces to be folded, for example the two sheet metal panels 38 and 39 illustrated in FIG. 1, into the correct position for carrying out the folding process, a stop rail 21 is provided which extends parallel to the U-shaped rails 7 and 8 and is carried by two pivot arms 22 which are mounted on the arm 5 for pivoting movement about a horizontal pivot axis 23 parallel to the U-shaped rails 7 and 8. In the horizontal position of the pivot arms 22, the stop rail 21 is upwardly open so that the sheet metal panel 39 abutting on the supporting surface 6 can engage therein. As soon as this sheet metal panel is firmly clamped by the clamping devices 9 and 10, the stop rail 21 is pivoted away downwards. For this purpose, the end of the pivot arms 22 protruding beyond the outer side of the arm 5 is pivoted upwards.

Figure 3:
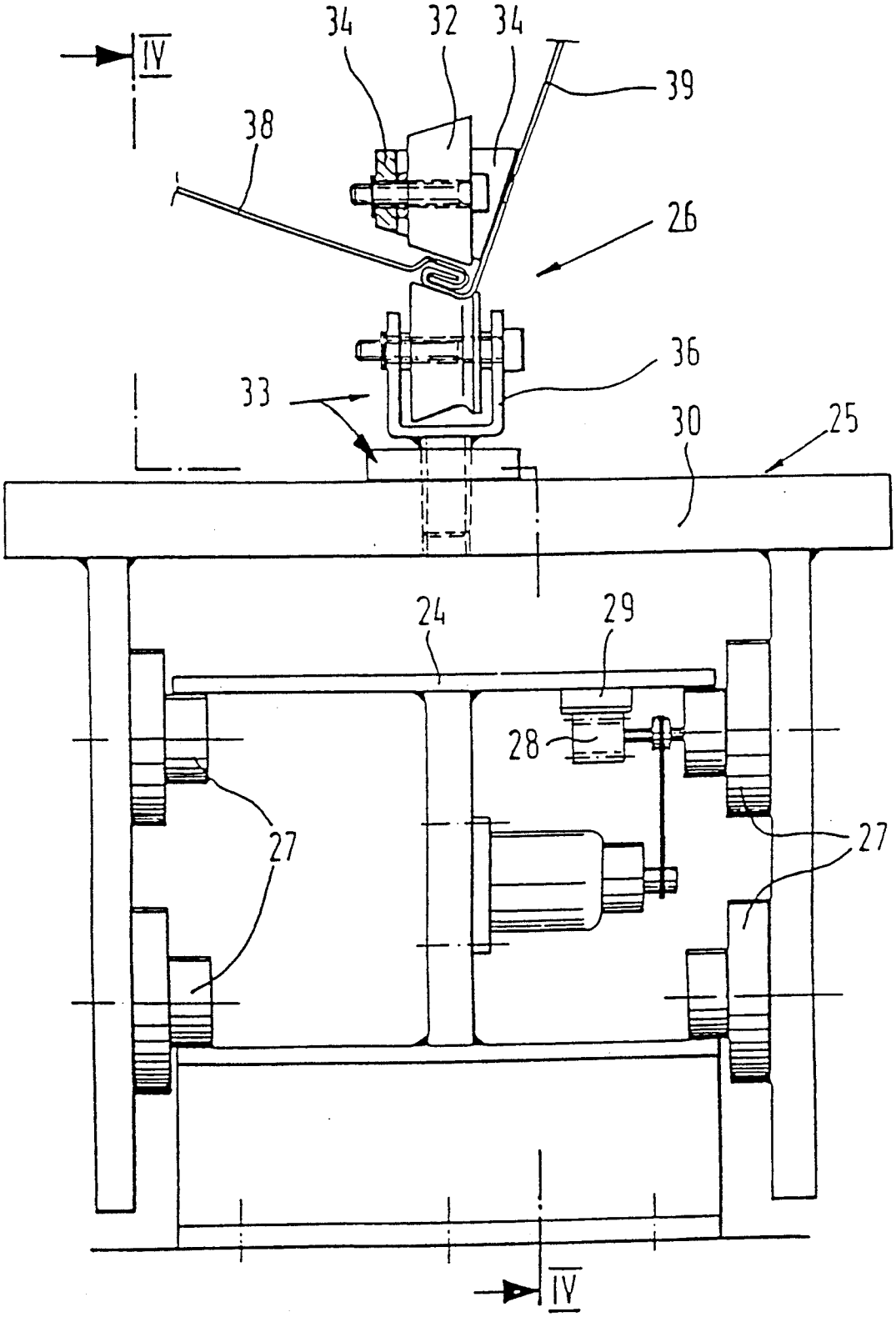
FIG. 3 is a cross section of the carriage.

A guide rail 24 is secured to the upper side of the yoke portion 2 between the two arms 3 and 5. This rail extends in the longitudinal direction of the channel limited by the yoke portion 2 and the arms 3 and 5 and beyond the end faces of the machine frame 1, to an extent which is greater than the projecting length of the U-shaped rails 7 and 8. The upper portion of the guide rail 24 forms a double T profile. The guide rail 24 bears a carriage designated as a whole as 25, which for its part bears a folding device 26. As shown in FIG. 3, wheels 27 of the carriage 25 engage between the cross members of the guider rail 24, whereby the carriage is positively secured against any displacement transversely to the longitudinal extension of the guide rail 24. A pinion 28 is arranged adjacent one of the wheels 27 and this pinion meshes with a gear rack 29 provided on the underside of the upper cross member of the guide rail 24. The pinion 28 is driven by an electric geared motor also arranged in the carriage 25; this motor can be operated optionally in either of the directions of rotation. The pinion can, for example, be driven via a chain.

The carriage 25 which is U-shaped in cross section bears on a platform 30, from which the arms bearing the wheels 27 extend downwards on both sides of the guide rail 24, an elongated carrier device 31 which extends in the direction of travel of the carriage 25 and bears a plurality of pairs of folding rollers 32 arranged one behind the other in the direction of travel.

Figure 4:
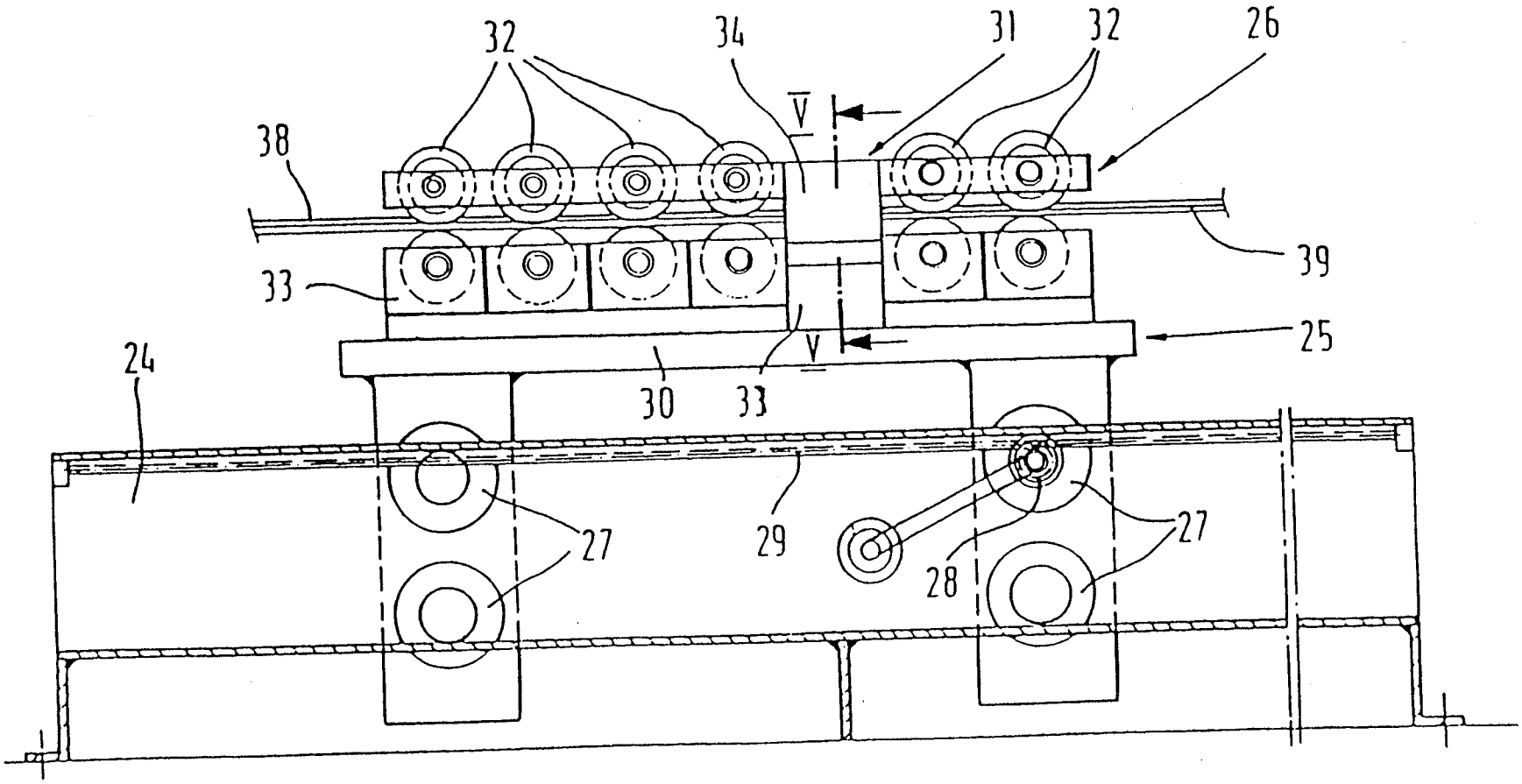
FIG. 4 is a side view of the carriage and the guide rail bearing the carriage.

As shown in FIG. 5, the carrier device 31 consists of a bar-shaped lower member 33 and a likewise bar-shaped upper member 34 which are connected with one another via a narrow web 35 which is inclined to correspond the inclined position of the supporting surface. As shown in FIG. 6, this web 35 tapers off towards its rearward half because here the edge zones of the two metal sheets which are to be joined together must be brought together. As shown, in particular, in FIG. 4, the lower member 33 and the upper member 34 project beyond the web 35 to the extent necessary for accommodating the pairs of folding rollers 32. In the embodiment, the web 35 is arranged between the second and third pairs of folding rollers.

The upper folding rollers of each pair of folding rollers 32 are, as shown, in particular, in FIG. 3, each rotatably mounted on a pivot pin protruding from the upper member 34. A corresponding mounting could also be provided for the lower folding rollers. In the embodiment, these are, however, as also shown in FIG. 3, each rotatably mounted in a U-shaped holder 36 which is connected with the lower member 33 so as to be vertically adjustable. At least the folding rollers of the first pair of folding rollers 32 are, as shown in FIG. 7, slightly skewed in order to press the sheet metal panel 38 transversely to the direction of travel of the carriage 25 against a stop 37 provided on the machine frame 1. This ensures that the sheet metal panel 38 abuts during the folding process on the stop 37. It is, of course, possible to have the axes of the subsequent pairs of folding rollers 32 also inclined accordingly. Generally, this is not, however, necessary.

Figure 10:
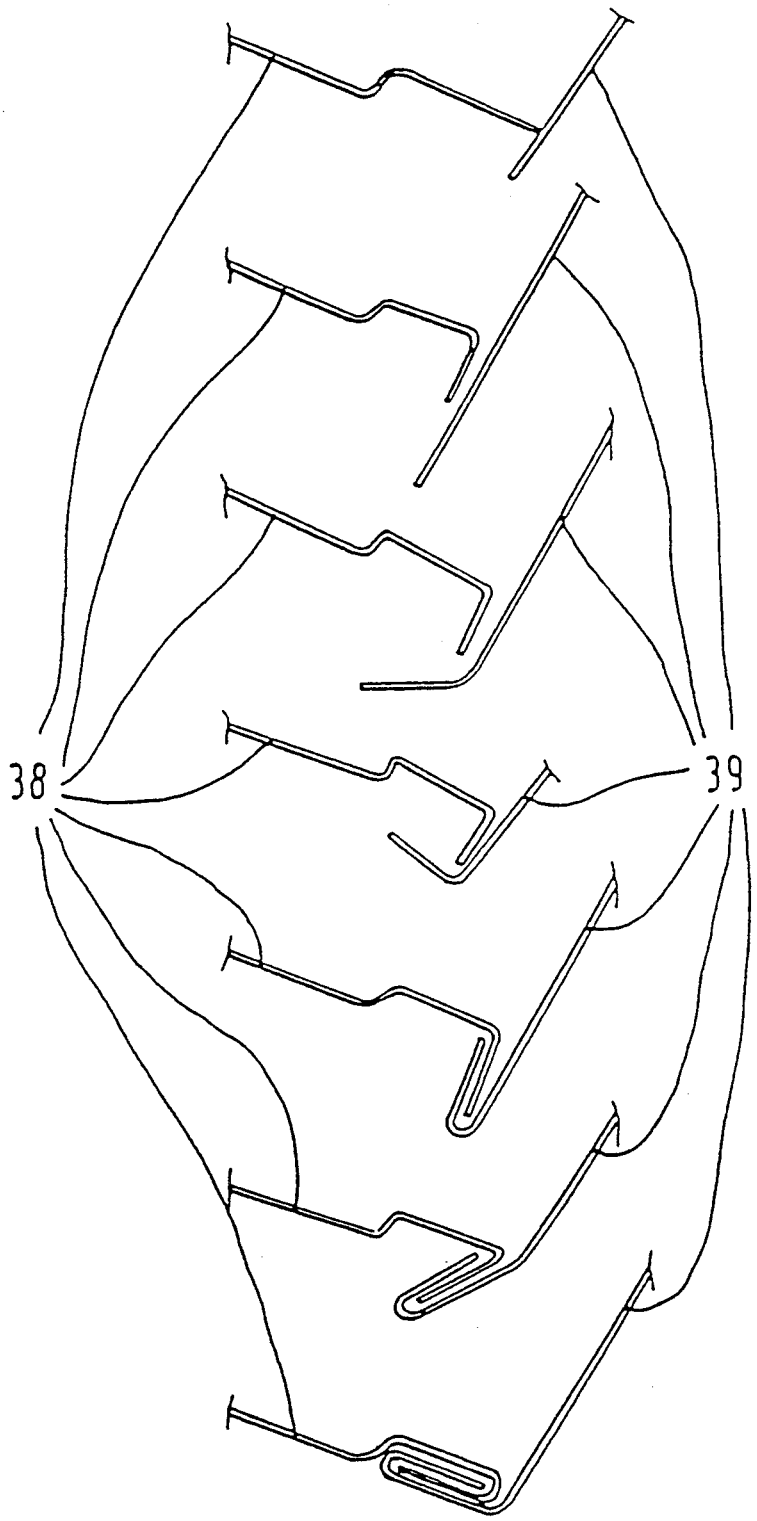
FIG. 10 shows the steps made by the folding rollers for deforming two metal sheets to be connected with one another by folding.

If the sheet metal panels 38 and 39, which are at right angles to one another, are intended to be joined to one another along their one edge zone, these two sheet metal panels 38 and 39 are placed on the supporting surfaces 4 and 6, respectively, as shown in FIG. 1. The lower edge of the sheet metal panel 39 hereby abuts on the base of the stop rail 21. The edge of the sheet metal panel 38 facing the sheet metal panel 39 hereby points towards a line running parallel to and spaced from the edge lying in the stop rail 21. The two sheet metal panels 38 and 39 are now secured in position with the aid of the clamping devices 9 and 10. Subsequently, the stop rail 21 is pivoted downwards so that the carriage 25 can now be moved against the front end of the two sheet metal panels 38 and 39. The first of the pairs of folding rollers 32 borne by the carriage 25 deforms, first of all, only the edge of the sheet metal panel 38 in the sense of a double bend, as illustrated at the top of FIG. 10. The second pair of folding rollers 32 forms from this doubly bent edge zone a downwardly open U-shaped profile. The third pair of folding rollers bends the edge zone of the sheet metal panel 39 inwards and the fourth pair of folding rollers presses the bent sheet metal strip upwards such that, as shown in FIG. 10, the long leg of the U-shaped profile of the sheet metal panel 38 is taken up by the fold of the sheet metal panel 39. This fold is now bent inwards by the fifth pair of folding rollers and, as shown in FIG. 10, pressed by the sixth pair of folding rollers into the recess which was first formed by the double bending of the sheet metal panel 38.

As soon as the carriage 25 has released the rear end of the two sheet metal panels 38 and 39, the clamping devices 9 and 10 can be released. Insofar as, for example, a duct is to be formed from the two sheet metal panels 38 and 39, these sheet metal panels need only be turned about the longitudinal axis of the duct, which is substantially simpler than transporting the sheet metal panels. In addition, the sheet metal panels 38 and 39 need not be held firmly during the folding processes. The operating personnel need, therefore, only switch the drive motor of the carriage on and off for the folding processes.

All the features mentioned in the preceding description as well as those only disclosed in the drawings are, as further developments, all part of the invention, even if they are not especially emphasized and, in particular, not specified in the claims.

I claim:

1. Folding machine for joining the edges of two metal sheets (38, 39) forming an angle of 90 degrees between them, comprising a machine frame (1) having two supporting surfaces (4, 6) for the metal sheets to be joined and likewise forming an angle of 90 degrees between them, holding devices (9, 10) for holding the metal sheets on the supporting surfaces and a carriage (25) driven by a drive device along a guide means of the machine frame comprising a guide rail (24), said carriage bearing at least one folding roller (32) for bending a metal sheet edge, characterized in that the machine frame (1) has a U-shaped cross-sectional profile and each of the two supporting surfaces (4, 6) for the metal sheets (38, 39) to be joined is provided in the region of an upper end of one of the two upwardly printing U-shaped arms (3, 5) of the machine frame with one of said supporting surfaces extending generally in the vertical direction, that the guide rail (24) of the carriage (25) is arranged in the region between the arms on a yoke portion (2) connecting the two U-shaped arms (3, 5) with one another at the bottom, that the carriage (25) bears a plurality of pairs of folding rollers (32) bending the sheet metal edges step by step, and that a pivoting device comprising at least one pivot arm (22) is provided, said pivot arm being mounted on the machine frame (1) for pivoting movement about an axis (23) parallel to the direction of travel of the carriage (25) and bearing a stop rail (21) parallel to and spaced from this axis (23), the stop rail for its part being located in a lockable operative position of the pivot arm (22), with the rail at a distance beneath the lower end of the one supporting surface (6) extending generally in the vertical direction.

2. Folding machine as defined in claim 1, characterized in that the drive device comprises means (28, 29) supported on the machine frame (1) and driven by a motor.

3. Folding machine as defined in claim 2, characterized in that the motor-driven means consist of at least one gear rack (29) extending in the direction of transport of the carriage (25) and at least one gear wheel (28) meshing with the gear rack (29).

4. Folding machine as defined in claim 3, characterized in that the gear rack (29) is rigidly connected with the machine frame (1), and the gear wheel (28) is driven via a gearing by an electromotor arranged on the carriage (25).

5. Folding machine as defined in claim 1, characterized in that the two supporting surfaces (4, 6) forming an angle of 90 degrees between them are inclined in relation to the horizontal and the vertical, respectively, and the one supporting surface (6) is inclined out of the vertical in a direction opposite from that of the other supporting surface (4).

6. Folding machine as defined in claim 5, characterized in that the two supporting surfaces (4, 6) are inclined at an angle of approximately 20° relative to the horizontal and the vertical, respectively.

7. Folding machine as defined in any of claim 1, characterized in that two holding devices (9, 10) are associated with each of the two supporting surfaces (4, 6), a metal sheet or the like abutting on the supporting surface (4, 6) being connectable via said holding devices with the machine frame (1) in the region of its forward or rearward edge, respectively.

8. Folding machine as defined in claim 7, characterized in that each of the two pairs of holding devices (9, 10) is provided on a rail (7, 8) rigidly connected with the machine frame (1) and extending in the direction of travel of the carriage (25).

9. Folding machine as defined in claim 8, characterized in that the holding devices (9, 10) are designed as clamping devices overlapping the edge of the metal sheet (38, 39) to be held.

10. Folding machine as defined in claim 9, characterized in that at least the one of the two holding devices (9, 10) of each pair is connected with the rail (7, 8) so as to be displaceable by means of an actuating lever (15) in the longitudinal direction of the rail in an amount somewhat exceeding the extent of overlap.

11. Folding machine as defined in claim 1, characterized in that the carriage (25) is provided in the direction of travel with wheels (27) mutually spaced from one another and positively engaging on the guide rail (24) both in the horizontal and vertical directions.

12. Folding machine as defined in claim 1, characterized in that the carriage (25) bears a carrier device (31) for the pairs of folding rollers (32) arranged one behind the other in the direction of travel, said carrier device extending in the direction of travel.

13. Folding machine as defined in claim 12, characterized in that a bar-shaped upper member (34) of the carrier device (31) is rigidly connected via a connecting web (35) with a bar-shaped lower member (33) and the carriage (25) between the first and last, preferably between the second and third pairs of folding rollers (32).

14. Folding machine as defined in claim 1, characterized in that at least the first pair of folding rollers (32) is inclined to the direction of travel.

15. Folding machine as defined in claim 1, characterized in that at least one folding roller of each pair of folding rollers (32) is arranged on the holding device (31) so as to be vertically adjustable.

* * * * *

UNITED STATES PATENT AND TRADEMARK OFFICE

CERTIFICATE OF CORRECTION

PATENT NO. : 5,184,384

DATED : February 9, 1993

INVENTOR(S) : Xaver Lipp

It is certified that error appears in the above-identified patent and that said Letters Patent is hereby corrected as shown below:

In Claim 1, col. 5, line 61:

Change "printing" to --pointing--.

Signed and Sealed this

Twenty-sixth Day of October, 1993

*Attest:*

Bruce Lehman

BRUCE LEHMAN

*Attesting Officer*

*Commissioner of Patents and Trademarks*